US010274865B2

(12) United States Patent
Furuta et al.

(10) Patent No.: US 10,274,865 B2
(45) Date of Patent: Apr. 30, 2019

(54) DEVELOPING DEVICE AND IMAGE FORMING APPARATUS

(71) Applicant: KONICA MINOLTA, INC., Chiyoda-ku, Tokyo (JP)

(72) Inventors: Tatsuya Furuta, Tokyo (JP); Tetsuya Ishikawa, Kanagawa (JP); Hiroyuki Saito, Tokyo (JP); Tomohiro Kawasaki, Kanagawa (JP); Ryoei Ikari, Saitama (JP); Aiko Kubota, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/103,299

(22) Filed: Aug. 14, 2018

(65) Prior Publication Data

US 2019/0049878 A1 Feb. 14, 2019

(30) Foreign Application Priority Data

Aug. 14, 2017 (JP) ..... 2017-156570

(51) Int. Cl.

| | |
|---|---|
| ***G03G 15/08*** | (2006.01) |
| ***G03G 15/00*** | (2006.01) |
| ***G03G 15/09*** | (2006.01) |

(52) U.S. Cl.

CPC ..... *G03G 15/0865* (2013.01); *G03G 15/0935* (2013.01); *G03G 15/5008* (2013.01); *G03G 15/5041* (2013.01)

(58) Field of Classification Search

USPC ..... 399/38, 46, 53, 107, 110, 119, 252, 258, 399/265, 267, 269

See application file for complete search history.

(56) References Cited

U.S. PATENT DOCUMENTS

| | | | | |
|---|---|---|---|---|
| 8,509,659 | B2 * | 8/2013 | Sawano | G03G 15/0818 399/269 |
| 8,989,637 | B2 * | 3/2015 | Yoshii | G03G 15/0921 399/269 |
| 9,026,011 | B2 * | 5/2015 | Kubo | G03G 15/0849 399/269 |

FOREIGN PATENT DOCUMENTS

JP 2012211937 A 11/2012

* cited by examiner

*Primary Examiner* — Hoan H Tran

(74) *Attorney, Agent, or Firm* — Cantor Colburn LLP

(57) ABSTRACT

A developing device includes: an image bearing member; a plurality of developing rollers each supplying toner to the image bearing member, and developing an electrostatic latent image on the image bearing member into a toner image; and a hardware processor analyzing values representing density fluctuations during the toner being supplied from the developing rollers to the image bearing member, for the respective developing rollers, and correcting a control value for an image density of at least one developing roller among the developing rollers based on an result of the analyzing so as to eliminate the density fluctuations, in consideration of an effect caused at the developing roller on a downstream side in a rotational direction of the image bearing member by correcting the control value for the image density of the developing roller on an upstream side.

12 Claims, 17 Drawing Sheets

| | FIRST DEVELOPING ROLLER | SECOND DEVELOPING ROLLER |
|---|---|---|
| CORRECTION TARGET | DEVELOPMENT θ | DEVELOPMENT θ |
| | DEVELOPMENT θ | AC |
| | AC | AC |
| | AC | DEVELOPMENT θ |

FIG. 6

| ITEM | FIRST DEVELOPING ROLLER | SECOND DEVELOPING ROLLER |
|---|---|---|
| DENSITY UNEVENNESS | $A \sin(\omega_A \cdot t)$ | $B \sin(\omega_B \cdot t - \alpha)$ |
| CORRECTION AMOUNT | $-A \sin(\omega_A \cdot t)$ | $-B \sin(\omega_B \cdot t - \alpha)$ |

FIG. 10

| DIRECT CORRECTION FROM UNEVENNESS OF EACH DEVELOPING ROLLER | | |
|---|---|---|
| ITEM | FIRST DEVELOPING ROLLER | SECOND DEVELOPING ROLLER |
| INITIAL IMAGE DENSITY UNEVENNESS | $A \sin(\omega_A \cdot t) + B \sin(\omega_B \cdot t - \alpha)$ | |
| IMAGE DENSITY UNEVENNESS OF EACH DEVELOPING ROLLER | $A \sin(\omega_A \cdot t)$ | $B \sin(\omega_B \cdot t - \alpha)$ |
| CORRECTION AMOUNT | $-A \sin(\omega_A \cdot t)$ | $-B \sin(\omega_B \cdot t - \alpha)$ |
| AMOUNT OF EFFECT DUE TO CORRECTION | 0 | $-A \sin(\omega_A \cdot t - \beta/\omega_B)$ |
| FINAL CORRECTION AMOUNT | $-A \sin(\omega_A \cdot t)$ | $-B \sin(\omega_B \cdot t - \alpha) + A \sin(\omega_A \cdot t - \beta/\omega_B)$ |
| IMAGE DENSITY UNEVENNESS OF EACH DEVELOPING ROLLER DUE TO CORRECTION | 0 | 0 |
| IMAGE DENSITY UNEVENNESS AFTER CORRECTION | 0 | |

FIG. 11

| CORRECTION AT FIRST DEVELOPING ROLLER | | |
|---|---|---|
| ITEM | FIRST DEVELOPING ROLLER | SECOND DEVELOPING ROLLER |
| INITIAL IMAGE DENSITY UNEVENNESS | $A \sin(\omega_A \cdot t)+B \sin(\omega_B \cdot t-\alpha)$ | |
| IMAGE DENSITY UNEVENNESS OF EACH DEVELOPING ROLLER | $A \sin(\omega_A \cdot t)$ | $B \sin(\omega_B \cdot t-\alpha)$ |
| CORRECTION AMOUNT | $-A \sin(\omega_A \cdot t)-B \sin(\omega_B \cdot t-\alpha)$ | 0 |
| AMOUNT OF EFFECT DUE TO CORRECTION | 0 | $-A \sin(\omega_A \cdot t-\beta/\omega_B)-B \sin(\omega_B \cdot t-\alpha-\beta/\omega_B)$ |
| FINAL CORRECTION AMOUNT | $-A \sin(\omega_A \cdot t)-B \sin(\omega_B \cdot t-\alpha)$ | $A \sin(\omega_A \cdot t-\beta/\omega_B)+B \sin(\omega_B \cdot t-\alpha-\beta/\omega_B)$ |
| IMAGE DENSITY UNEVENNESS OF EACH DEVELOPING ROLLER DUE TO CORRECTION | $-B \sin(\omega_B \cdot t-\alpha)$ | $B \sin(\omega_B \cdot t-\alpha)$ |
| IMAGE DENSITY UNEVENNESS AFTER CORRECTION | 0 | |

FIG. 15

| CORRECTION SHARED | | |
|---|---|---|
| ITEM | FIRST DEVELOPING ROLLER | SECOND DEVELOPING ROLLER |
| INITIAL IMAGE DENSITY UNEVENNESS | $A \sin(\omega_A \cdot t)+B \sin(\omega_B \cdot t -\alpha)$ | |
| IMAGE DENSITY UNEVENNESS OF EACH DEVELOPING ROLLER | $A \sin(\omega_A \cdot t)$ | $B \sin(\omega_B \cdot t -\alpha)$ |
| CORRECTION AMOUNT | $-1/2*A \sin(\omega_A \cdot t)$ | $-1/2*A \sin(\omega_A \cdot t)-B \sin(\omega_B \cdot t -\alpha)$ |
| AMOUNT OF EFFECT DUE TO CORRECTION | 0 | $-1/2*A \sin(\omega_A \cdot t -\beta/\omega_B)$ |
| FINAL CORRECTION AMOUNT | $-1/2*A \sin(\omega_A \cdot t)$ | $-1/2*A \sin(\omega_A \cdot t)-B \sin(\omega_B \cdot t -\alpha)+1/2*A \sin(\omega_A \cdot t -\beta/\omega_B)$ |
| IMAGE DENSITY UNEVENNESS OF EACH DEVELOPING ROLLER DUE TO CORRECTION | $1/2*A \sin(\omega_A \cdot t)$ | $-1/2*A \sin(\omega_A \cdot t)$ |
| IMAGE DENSITY UNEVENNESS AFTER CORRECTION | 0 | |

FIG. 16

| CORRECTION AT SECOND DEVELOPING ROLLER | | |
|---|---|---|
| ITEM | FIRST DEVELOPING ROLLER | SECOND DEVELOPING ROLLER |
| INITIAL IMAGE DENSITY UNEVENNESS | $A \sin(\omega_A \cdot t)+B \sin(\omega_B \cdot t - \alpha)$ | |
| IMAGE DENSITY UNEVENNESS OF EACH DEVELOPING ROLLER | $A \sin(\omega_A \cdot t)$ | $B \sin(\omega_B \cdot t - \alpha)$ |
| CORRECTION AMOUNT | 0 | $-A \sin(\omega_A \cdot t)-B \sin(\omega_B \cdot t - \alpha)$ |
| AMOUNT OF EFFECT DUE TO CORRECTION | 0 | 0 |
| FINAL CORRECTION AMOUNT | 0 | $-A \sin(\omega_A \cdot t)-B \sin(\omega_B \cdot t - \alpha)$ |
| IMAGE DENSITY UNEVENNESS OF EACH DEVELOPING ROLLER DUE TO CORRECTION | $A \sin(\omega_A \cdot t)$ | $-A \sin(\omega_A \cdot t)$ |
| IMAGE DENSITY UNEVENNESS AFTER CORRECTION | 0 | |

FIG. 17

DEVELOPING DEVICE AND IMAGE FORMING APPARATUS

CROSS REFERENCE TO RELATED APPLICATIONS

The present application claims priority under 35 U.S.C. § 119 to Japanese patent application No. 2017-156570, filed on Aug. 14, 2017, and the entire disclosure of which is incorporated herein by reference.

BACKGROUND

Technological Field

The present invention relates to a developing device, and an image forming apparatus.

Description of Related Art

Conventionally, developing devices that perform development using two-component developer containing toner and carriers have been widely used as developing devices used for image forming apparatuses, such as electrophotographic copiers, printers, and facsimile machines. In recent years, there has been a multi-stage developing device that supplies toner to an image bearing member through multiple developing rollers. This developing device can form a high-quality image by developing, multiple times, a latent image formed on an image bearing member.

The developing device, and an image forming apparatus are required to have density reproducibility of reproducing the density of an image with high fidelity. As for the density reproducibility, in the conventional developing device, the electric fields are fluctuated by the fluctuation of the gap at a developing nip section formed by the image bearing and the developing roller. The fluctuation causes the density fluctuation in the image density of a toner image developed on the image bearing member, and such density fluctuation in turn causes defects in a print image.

As a conventional technique for addressing the problem of density fluctuation, a technique has been known that corrects the density by a measure for changing a developing bias to be applied to the developing roller at the developing nip section with the image bearing member (for example, see Japanese Patent Application Laid-Open No. 2012-211937), or a measure for changing the development θ, i.e., the speed ratio of the developing roller to the image bearing member.

However, according to the multi-stage developing device, which includes multiple developing rollers, it is difficult to correct the density accurately through each of the measure for changing the developing bias and the measure for changing the development θ. As a result of earnest research, the present inventors have found out the cause of unimprovement in the density correction accuracy of the multi-stage developing device, and have resultantly proposed the present invention.

SUMMARY

The present invention has an object to provide a developing device and an image forming apparatus that can improve the density correction accuracy and suppress image defects.

In order to realize at least one of the above objects, a developing device reflecting an aspect of the present invention includes: an image bearer that forms an electrostatic latent image; a plurality of developing rollers each of which supplies toner to the image bearer, and develops the electrostatic latent image on the image bearer into a toner image; and a hardware processor that analyzes values representing density fluctuations during the toner being supplied from the developing rollers to the image bearer, for the respective developing rollers, and corrects a control value for an image density of at least one developing roller among the developing rollers based on a result of the analyzing so as to eliminate the density fluctuations, in which the hardware processor corrects the control value for the image density of the at least one developing roller in consideration of an effect caused at the developing roller on a downstream side in a rotational direction of the image bearing bearer by correcting the control value for the image density of the developing roller on an upstream side.

In order to realize at least one of the above objects, an image forming apparatus reflecting another aspect of the present invention includes: the developing device; a transferrer that transfers the toner image formed on the image bearer, onto a sheet; and a fixer that fixes the toner image transferred on the sheet.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 6 illustrates a combination of selectable correction targets according to this Embodiment;

FIG. 10 is a table illustrating the correction amount of primary correction for each developing roller;

FIG. 11 is a table illustrating the final correction amount and the like for each developing roller;

FIG. 15 is a table illustrating another example of a density correction process;

FIG. 16 is a table illustrating still another example of the density correction process; and FIG. 17 is a table illustrating yet another example of the density correction process.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
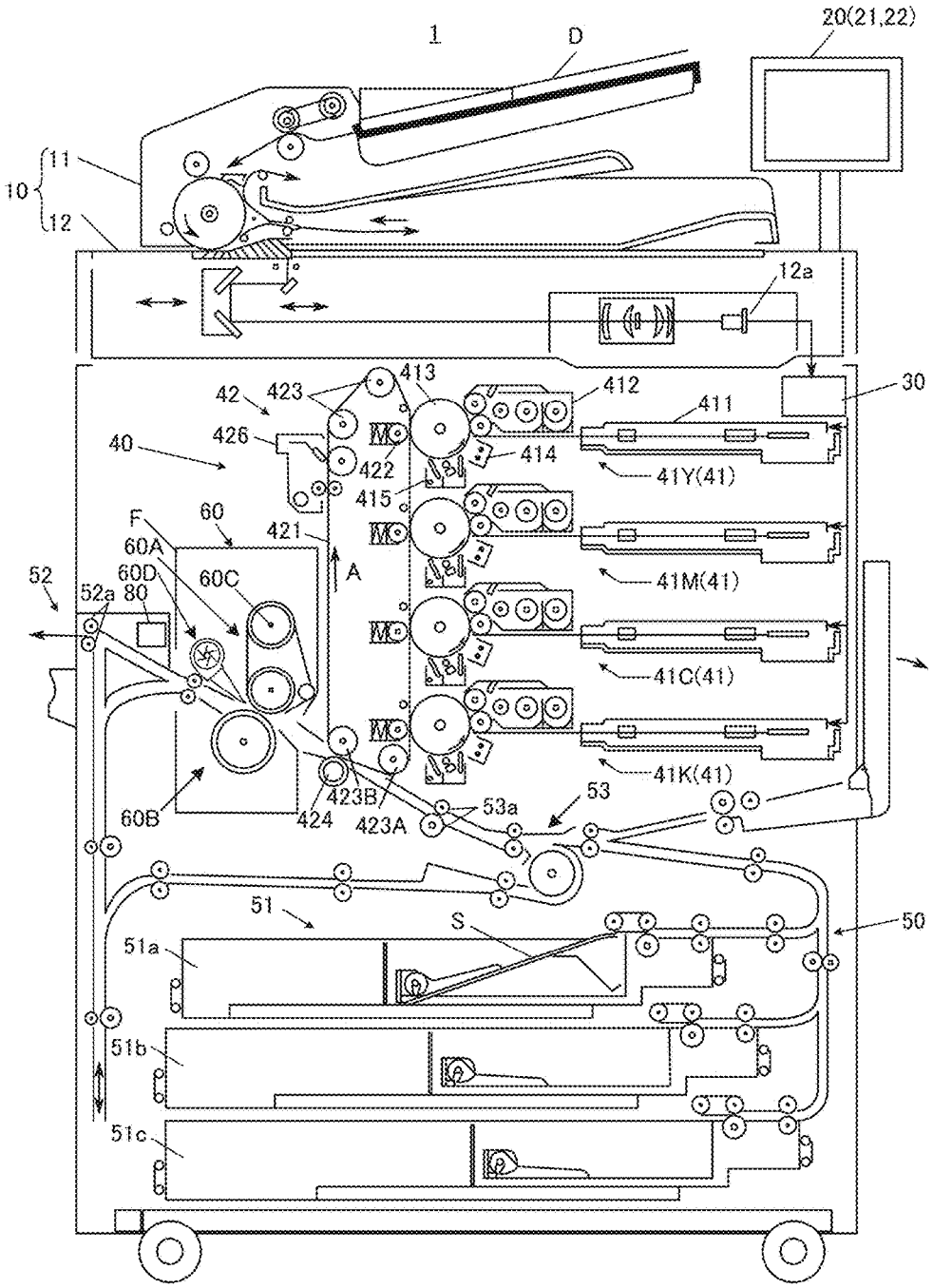
FIG. 1 schematically illustrates the entire configuration of an Image forming apparatus according to this Embodiment.
Figure 2:
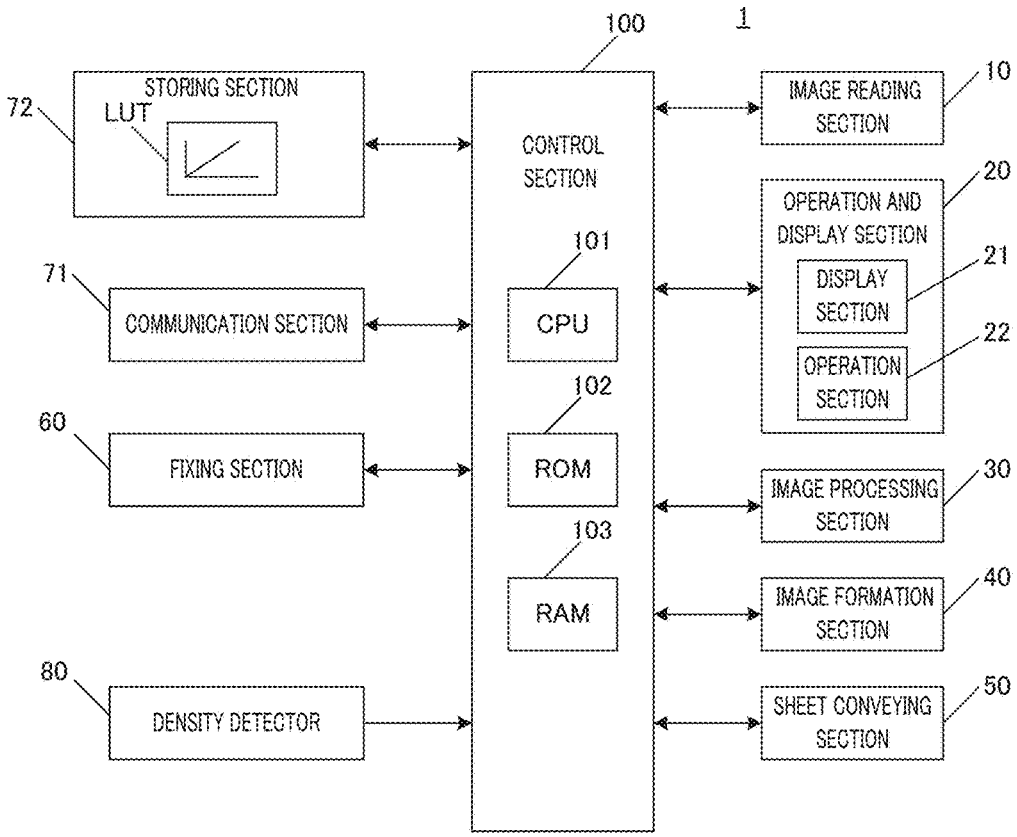
FIG. 2 illustrates a main part of a control system of the image forming apparatus according to this Embodiment.

FIG. 1 schematically illustrates the entire configuration of Image forming apparatus 1 according to this Embodiment. FIG. 2 illustrates a main part of a control system of image forming apparatus 1 according to this Embodiment.

FIG. 1 schematically illustrates the entire configuration of Image forming apparatus 1 according to the Embodiment of this invention. FIG. 2 illustrates a main part of a control system of image forming apparatus 1 according to this Embodiment. Image forming apparatus 1 illustrated in FIGS. 1 and 2 is an intermediate transfer system color image forming apparatus that uses an electrophotographic process technology. That is, image forming apparatus 1 primarily transfers Y(yellow)-, M(magenta)-, C(cyan)- and K(black)-color toner images formed on photoconductor drum 413, onto intermediate transfer belt 421, to overlap the four-color toner images on intermediate transfer belt 421 with each other, and subsequently secondarily transfers the images on sheet S to form a toner image.

Image forming apparatus 1 adopts a tandem system that arranges photoconductor drums 413 corresponding to four colors of YMCK, in series, in the traveling direction of intermediate transfer belt 421, and sequentially transfers the color toner images in a one-time procedure.

As illustrated in FIG. 2, image forming apparatus 1 includes image reading section 10, operation and display section 20, image processing section 30, image formation section 40, sheet conveying section 50, fixing section 60, density detecting sensor 80, and control section 100.

Control section 100 includes CPU (Central Processing Unit) 101, ROM (Read Only Memory) 102 and RAM (Random Access Memory) 103. CPU 101 reads a program according to the processing content from ROM 102, deploys the program on RAM 103, and controls the operation of each block of image forming apparatus 1 in a centralized manner in cooperation with the deployed program. At this time, various data items stored in storing section 72 are referred to. Storing section 72 may be made up of, for example, a nonvolatile semiconductor memory (what is called a flash memory) or a hard disk drive.

Control section 100 transmits and receives various data items, via communication section 71, to and from an external apparatus (e.g., a personal computer) connected to a communication network, such as LAN (Local Area Network), or WAN (Wide Area Network). For example, control section 100 receives image data transmitted from the external apparatus, and forms a toner image on a sheet S on the basis of the image data (input image data). Communication section 71 is made up of a communication control card, such as a LAN card, for example.

Image reading section 10 includes automatic document feeding device 11, which is called an ADF (Auto Document Feeder), and document image scanning device 12 (scanner).

Automatic document feeding device 11 causes the conveyance mechanism to convey document D laid on a document tray, toward document image scanning device 12. Automatic document feeding device 11 can sequentially read the images (including both faces) of multiple sheets of documents D laid on the document tray at one time.

Document image scanning device 12 optically scans the document conveyed from automatic document feeding device 11 onto a contact glass, or the document laid on the contact glass, forms an image of the light reflected from the document on a light receiving surface of CCD (Charge Coupled Device) sensor 12*a*, and reads a document image. Image reading section 10 generates input image data on the basis of a reading result by document image scanning device 12. A predetermined image process is applied to the input image data, in image processing section 30.

Operation and display section 20 includes, for example, a liquid crystal display (LCD) provided with a touch panel, and functions as display section 21 and operation section 22. Display section 21 displays various operation screens, the state of an image, the situation of operation of each function and the like, according to a display control signal input through control section 100. Operation section 22 includes various operation keys, such as a numeric key pad and a start key, accepts various input operations by a user, and outputs operation signals to control section 100.

Image processing section 30 includes a circuit that applies, to the input image data, digital image processing and the like according to initial setting or setting by the user. For example, image processing section 30 corrects the density on the basis of density correction data (density correction table LUT) in storing section 72 under control of control section 100. The details of such a density correction process are described later. Image processing section 30 applies not only the density correction, but also various correction processes, such as color correction and shading correction, a compression process and the like, to the input image data. Image formation section 40 is controlled on the basis of the image data to which these processes have been applied.

Image formation section 40 includes image forming units 41Y, 41M, 41C and 41K for forming Y-, M-, C- and K-component color toner images, and intermediate transfer unit 42, on the basis of the input image data.

Y-, M-, C- and K-component image forming units 41Y, 41M, 41C and 41K have an analogous configuration. For the sake of facilitating illustration and description, common configuration elements are indicated by the same symbol. To discriminate the elements from each other, the symbol is represented with Y, M, C or K attached thereto. In FIG. 1, the symbols are assigned only to the configuration elements of Y-component image forming unit 41Y, while the symbols to the configuration elements of the other image forming units 41M, 41C and 41K are omitted.

Image forming unit 41 includes exposing device 411, developing device 412, photoconductor drum 413, charging device 414 and drum cleaning device 415.

Photoconductor drum 413 is a negatively charged organic photoconductor (OPC) that includes: for example, a conductive cylinder made of aluminum (aluminum tube); and an under coat layer (UCL), a charge generation layer (CGL) and a charge transport layer (CTL) that are sequentially laminated on the peripheral surface of the photoconductor. For example, the diameter of photoconductor drum 413 is 80 mm. The charge generation layer of photoconductor drum 413 is made of an organic semiconductor where a charge generation material (e.g., phthalocyanine pigments) is dispersed in a resin binder (e.g., polycarbonate), and generates each pair of a positive charge and a negative charge through light exposure by exposing device 411. The charge transport layer is made up of a hole transport material (electron donor nitrogen-containing compound) and a resin binder (e.g., polycarbonate) in which the hole transport material is dispersed, and transports positive charges generated in the charge generation layer to the surface of the charge transport layer.

Control section 100 drives photoconductor drums 413 at a constant circumferential speed by controlling the drive current to be supplied to drive motors (not illustrated) that rotate photoconductor drums 413.

Charging devices 414 uniformly negatively charge the surfaces of respective photoconductor drums 413 having optical conductivity. Exposing devices 411 are made up of, for example, semiconductor lasers, and irradiate photoconductor drums 413 with laser light beams corresponding to the respective color-component images. Positive charges occur on the charge generation layers of photoconductor drums 413, and are transported to the surfaces of the charge transport layers, thereby neutralizing the surface charges (negative charges) on photoconductor drums 413. On the surfaces of photoconductor drums 413, respective color-component electrostatic latent images are formed by potential differences from the surroundings.

Developing devices 412 are, for example, two-component developing devices, and visualize electrostatic latent images by causing the corresponding color-component toner to adhere onto the surfaces of respective photoconductor drums 413, thereby forming the toner image.

Drum cleaning devices 415 include drum cleaning blades and the like that come into sliding contact with the surfaces of respective photoconductor drums 413, and remove transfer residual toner remaining on the surfaces of photoconductor drums 413 after primary transfer.

Intermediate transfer unit 42 includes intermediate transfer belt 421 serving as an image bearing member, primary transfer rollers 422, support rollers 423, secondary transfer roller 424, and belt cleaning device 426.

Intermediate transfer belt 421 is made up of an endless belt, and is stretched around support rollers 423 to form a loop. At least one of support rollers 423 is made up of a drive roller, and the others are made up of follower rollers. For example, it is preferable that roller 423A disposed on the downstream side of K-component primary transfer roller 422 in the belt traveling direction be a drive roller. This configuration facilitates maintaining the traveling speed of the belt in the primary transfer section to be constant. Rotation of drive roller 423A allows intermediate transfer belt 421 to travel in arrow A direction at a constant speed.

Primary transfer rollers 422 are disposed opposite to respective color-component photoconductor drums 413 and on an inner surface side of intermediate transfer belt 421. Primary transfer rollers 422 are pressed against respective photoconductor drums 413, with intermediate transfer belt 421 intervening therebetween, to form primary transfer nips for transferring toner images from photoconductor drums 413 to intermediate transfer belt 421.

Secondary transfer roller 424 is disposed on the outer peripheral surface side of intermediate transfer belt 421 and opposite to backup roller 423B disposed on the downstream side of drive roller 423A in the belt traveling direction. Secondary transfer roller 424 is pressed against backup roller 423B, with intermediate transfer belt 421 intervening therebetween, to form a secondary transfer nip for transferring the toner image from intermediate transfer belt 421 to sheet S.

While intermediate transfer belt 421 passes through the primary transfer nip, the toner images on photoconductor drums 413 are sequentially primarily transferred onto intermediate transfer belt 421 in an overlapping manner. More specifically, primary transfer biases are applied to primary transfer rollers 422, and charges having the polarity opposite to that of the toner are applied to the rear surface of intermediate transfer belt 421 (where contact is made with primary transfer roller 422), thereby allowing the toner image to be electrostatically transferred onto intermediate transfer belt 421.

Subsequently, while sheet S passes through the secondary transfer nip, the toner image on intermediate transfer belt 421 is secondarily transferred onto sheet S. More specifically, a secondary transfer bias is applied to secondary transfer roller 424, and charges having the polarity opposite to that of the toner are applied to the rear surface of sheet S (where contact is made with secondary transfer roller 424), thereby allowing the toner image to be electrostatically transferred onto sheet S. Sheet S onto which the toner image has been transferred is conveyed toward fixing section 60.

Belt cleaning section 426 includes a belt cleaning blade in sliding contact with the front surface of intermediate transfer belt 421, and removes transfer residual toner remaining on the surface of intermediate transfer belt 421 after secondary transfer. Instead of secondary transfer roller 424, a configuration may be adopted where the secondary transfer belt is stretched around multiple support rollers including the secondary transfer roller to form a loop (what is called a belt secondary transfer unit).

Fixing section 60 includes: upper fixing section 60A that includes a fixation surface side member disposed nearer to a fixation surface (a surface on which the toner image is formed) of sheet S; lower fixing section 60B that includes a rear surface side support member disposed nearer to the rear surface (the surface opposite to the fixation surface) of sheet S; and a heat source 60C. The rear surface side support member is pressed against the fixation surface side member, thereby forming a fixation nip for clamping and conveying sheet S.

In fixing section 60, the toner image is secondarily transferred, conveyed sheet S is heated and pressurized by the fixation nip, thereby fixing the toner image onto sheet S. Fixing section 60 is arranged as a unit in fixing device F. Air separation unit 60D that separates sheet S from the fixation surface side member by blowing air, is disposed in fixing device F.

Sheet conveying section 50 includes sheet feeding section 51, sheet ejector section 52, and conveyance path section 53. Three sheet feed tray units 51*a* to 51*c*, which constitute sheet feeding section 51, store sheets S identified based on the basis weight, size and the like (standard sheets and special sheets), according to preset types. Conveyance path section 53 includes multiple conveyance roller pairs, such as registration roller pair 53*a*.

Sheets S stored in sheet feed tray units 51*a* to 51*c* are transmitted one by one from the top, and are conveyed through conveyance path section 53 to image formation section 40. At this time, the inclination of fed sheet S is corrected and the conveyance timing is adjusted, by a registration roller section provided with registration roller pair 53*a*. In image formation section 40, the toner images on intermediate transfer belt 421 are collectively secondarily transferred onto one surface of sheet S. In fixing section 60, a fixation process is applied. Image-formed sheet S is ejected to the outside by sheet ejector section 52 provided with sheet ejection roller 52*a*.

Density detector 80 detects the density of the image formed on sheet S serving as an image bearing member. In this Embodiment, density detector 80 is an optical sensor that includes: multiple light emitting elements (e.g., infrared LED arrays emitting infrared light) serving as light emitting sections that emit light; and light receiving elements (e.g., photodiodes) serving as light receiving sections that receive reflected light of such light. Hereinafter, the density detector is called a density detecting sensor.

Density detecting sensor 80 operates on the basis of a control signal of control section 100, and outputs the value of the density of the image formed on sheet S as density data to control section 100.

In this Embodiment, density detecting sensor 80 is disposed downstream of fixing section 60 and upstream of sheet ejector section 52. Density detecting sensor 80 is disposed so that the multiple infrared LED arrays can be positioned in the width direction of sheet S (the direction orthogonal to the conveyance direction).

Density detecting sensor 80 irradiates image-formed sheet S with infrared light through each infrared LED array, receive light through the photodiodes, and outputs an electric signal according to such an amount of received light (the density of the image on sheet S), as a detection signal (density data) of toner density, to control section 100.

Figure 3:
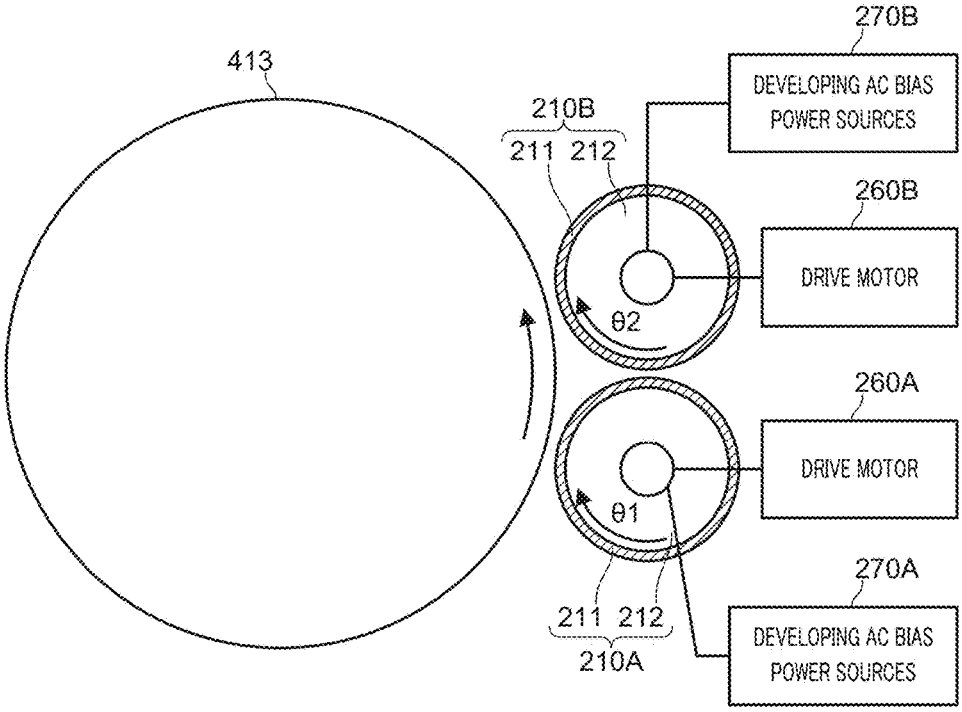
FIG. 3 schematically illustrates a developing device according to this Embodiment.

Next, referring to FIG. 3, the configuration of developing device 412 is described. Developing device 412 of this Embodiment is a multi-stage developing apparatus that includes multiple (two) developing rollers 210A and 210B.

Developing device 412 develops the electrostatic latent image formed on photoconductor drum 413 serving as an image bearing member, using developer containing toner and magnetic carriers, thereby forming the toner image on photoconductor drum 413. In each developing device 412, developing roller 210A is disposed upstream of photoconductor drum 413 in the rotational direction, and developing roller 210B is disposed downstream thereof. These developing rollers 210A and 210B supply photoconductor drum 413 with the developer (toner), and develop the electrostatic latent image on photoconductor drum 413 into the toner image.

Although not illustrated in FIG. 3, developing device 412 includes: a developing tank that stores supplied developer; a stirring screw that stirs the developer in the developing tank; and a supply roller that supplies the stirred developer to developing rollers 210A and 210B and collects the remaining developer.

Developing rollers 210A and 210B each include rotatable developing sleeve 211, and developing magnet roll 212 disposed in developing sleeve 211. Developing rollers 210A and 210B are each disposed close to photoconductor drum 413, and convey the developer to a developing area that is close to photoconductor drum 413. In one example, developing sleeves 211 and 211 of developing rollers 210A and 210B each have a gap of 0.30 mm to photoconductor drum 413, and convey 220 g of developer.

Developing sleeves 211 and 211 of developing rollers 210A and 210B each have the same diameter (e.g., 25 mm). Under control of control section 100, the powers of drive motors 260A and 260B are transmitted, thereby allowing these rollers to be rotated at a predetermined surface speed (circumferential speed) in the clockwise direction in FIG. 3. According to an example, as for the initial setting values of the circumferential speeds of developing sleeves 211, developing sleeve 211 of developing roller 210A is set to have a value of 600 mm/sec., and developing sleeve 211 of developing roller 210B is set to have a value of 480 mm/sec. Consequently, in this example, the initial value of development θ (θ1) of developing roller 210A, and the initial value of development θ (θ2) of developing roller 210B are different from each other.

In each of developing magnet roll 212 in developing rollers 210A and 210B, multiple magnetic poles for generating magnetic fields are arranged. The bias currents of developing AC bias power sources 270A and 270B are applied to respective developing magnet rolls 212 and 212 under control of control section 100, thereby supplying photoconductor drum 413 with the toner contained in the developer (with 7 mass %, for example).

The bias currents output from developing AC bias power sources 270A and 270B are each a current having a direct-current (DC) component and an alternating-current (AC) component. In one example, the initial values of bias currents of developing AC bias power sources 270A and 270B each have a DC-component voltage of 400 V, and an AC-component voltage with a peak-to-peak voltage (Vpp) of 1 kV and a frequency of 5 kHz. Consequently, in this example, the developing AC bias power sources 270A and 270B have the same initial value.

When the developer is supplied from the supply roller described above to developing rollers 210A and 210B in developing device 412, the magnetic fields generated by developing magnet rolls 212 and 212 cause magnetic brushes on the outer peripheral surfaces of developing sleeves 211 and 211, and layers of developer are formed on the respective outer peripheral surfaces of developing sleeves 211 and 211. Developing sleeves 211 and 211 each rotate in the clockwise direction in the diagram, thereby conveying the developer to the developing area (hereinafter called a developing nip section) closest to photoconductor drum 413 while the developer is carried on the outer peripheral surfaces of developing sleeves 211 and 211 by the magnetic fields. At such a developing nip section, the layers of the developer are in contact with the surface of photoconductor drum 413. The toner contained in the developer at this time electrostatically transitions from developing sleeves 211 to the electrostatic latent image formed on the surface of photoconductor drum 413. As described above, developing device 412 visualize, in a multi-stage manner, the electrostatic latent image on photoconductor drum 413 with the toner supplied from developing rollers 210A and 210B. That is, developing device 412 allows developing rollers 210A and 210B to develop twice the electrostatic latent image formed on photoconductor drum 413. Consequently, this device can form an image having a higher quality than a developing device that includes a single developing roller.

When the roundness of each of developing rollers 210A and 210B decreases owing to durability exhaustion and the like, a gap fluctuation occurs where the gap of the developing nip section between photoconductor drum 413 and each of developing rollers 210A and 210B is uneven. Such gap fluctuation causes fluctuation in electric field at the developing nip section. Consequently, the rate of toner supplied from developing rollers 210A and 210B to photoconductor drum 413 becomes unstable, which becomes a cause of density fluctuation where the image density of the toner image on photoconductor drum 413 fluctuates. The density fluctuation causes defect in the image printed on sheet S. Accordingly, the density correction for addressing the gap fluctuation is required.

A conventional density correction technique for addressing such a problem corrects the control value (the developing bias or development θ) for controlling the image density on the developing roller. That is, measures for correcting the control value are roughly classified into a measure for changing the developing bias to be applied to developing roller 210A (210B) at the developing nip section, and a measure for changing development θ, i.e., the speed ratio between photoconductor drum 413 and developing roller 210A (210B).

However, according to multi-stage developing device 412, which includes multiple developing rollers 210A and 210B, it is difficult to correct the density accurately through each of the measures. As results of various experiments performed by the present inventors in consideration of this point, it was found that when the developer was passed from developing rollers 210A and 210B to photoconductor drum 413, the developer was actually passed from upstream developing roller 210A also to downstream developing roller 210B. A knowledge was obtained where based on the phenomenon of passing the developer from developing roller 210A to developing roller 210B, the values (correction values) of the developing bias and the development θ caused errors.

Based on the knowledge described above, in this Embodiment, control section 100 separately calculates the correction values for the density fluctuations to occur in respective developing rollers (210A and 210B), and sets the final correction values in consideration of the effect of the correction value for upstream developing roller 210A on downstream developing roller 210B.

In an overview, control section 100 has a role as an analysis section that obtains, from density detecting sensor 80, values indicating the density fluctuations (hereinafter also called density unevenness) during supply of the toner from multiple developing rollers 210A and 210B to photoconductor drum 413, and analyzes the values indicating the density fluctuations for the respective developing rollers 210A and 210B. Control section 100 also has a role as a density correcting section that corrects the control value for the image density for at least one of developing rollers 210A and 210B, based on the analysis result.

This Embodiment having such a configuration can achieve highly accurate density correction, and effectively prevent image defects from occurring in the toner image to be printed.

In this Embodiment, control section 100 performs the density correction process according to the following procedures.

(1) Measure the fluctuation amount of image density (create and detect an image patch)

(2) Analyze amplitudes A and B and phase difference α at developing rollers 210A and 210B (3) Select a correction target (a control value to be corrected) pertaining to the densities on developing rollers 210A and 210B (4) Calculate the correction amount for the selected correction target (5) Calculate the amount of effect of the correction value for one developing roller on the other developing roller (6) Determine the final correction amounts for developing rollers 210A and 210B Hereinafter, processes of procedures (1) to (6) described above are sequentially described with reference to the drawings. In the following description, upstream developing roller 210A is appropriately called first developing roller 210A, and downstream developing roller 210B is appropriately called second developing roller 210B.

(1) Measure the Fluctuation Amount of Image Density (Create and Detect an Image Patch)

Figure 4:
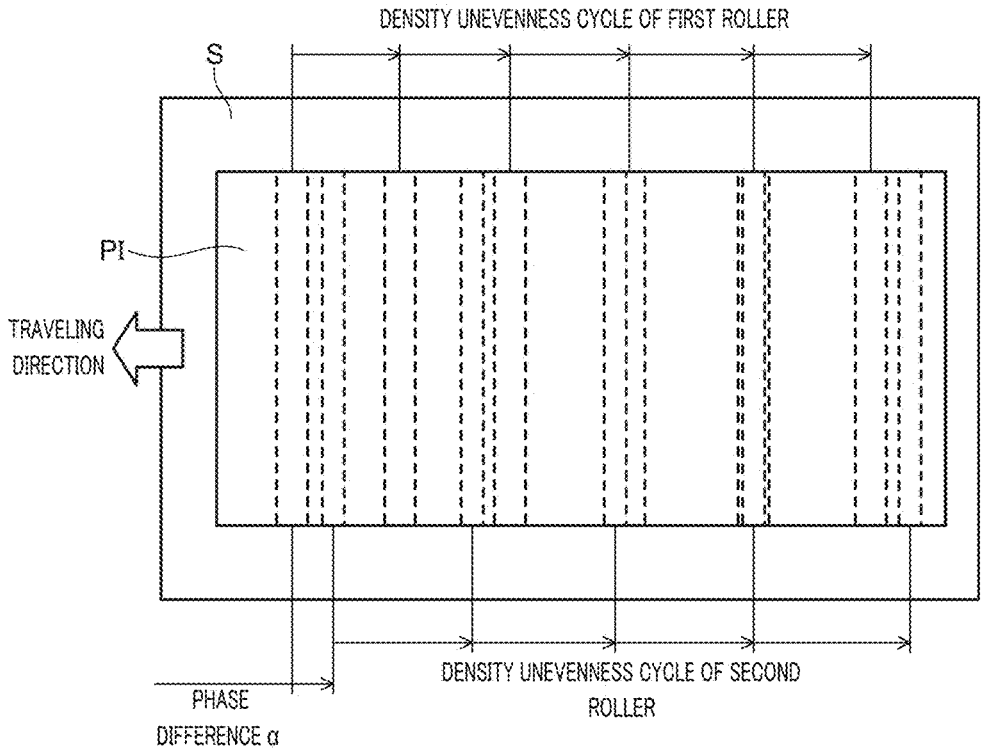
FIG. 4 illustrates an example of a result of detecting the density unevenness of a patch image according to this Embodiment.

FIG. 4 illustrates an example of a result of detecting the density unevenness of patch image PI created according to this Embodiment. In this Embodiment, a rectangular toner image having a single color and a single density (what is called a solid image) is printed as patch image PI on sheet S, and the density of thus printed patch image PI is detected using density detecting sensor 80.

If the roundness of each of developing rollers 210A and 210B is low owing to, for example, durability exhaustion or the like during creation of patch image PI, the gap at the developing nip section between photoconductor drum 413 and each of developing rollers 210A and 210B is not constant, and such gap fluctuation causes the density unevenness in patch image PI to be printed. As described above with reference to FIG. 3, in this example, the circumferential speed of first developing roller 210A is higher than the circumferential speed of second developing roller 210B. Consequently, as illustrated in FIG. 4, as for the density unevenness appearing in patch image PI, the density unevenness caused from first developing roller 210A has a shorter density cycle than the density unevenness caused from second developing roller 210B has.

This Embodiment adopts the configuration that forms patch image PI on sheet S, and causes density detecting sensor 80 disposed downstream of fixing section 60 in the conveyance direction of sheet S to detect the density of patch image PI after toner fixation. According to another example, a configuration may be adopted that disposes density detecting sensor 80 in proximity to photoconductor drum 413 or intermediate transfer belt 421, and causes density detecting sensor 80 to detect the density of patch image PI before fixation.

(2) Analyze Amplitudes A and B of the Density Unevenness and Phase Difference α at Developing Rollers 210A and 210B Based on the detection result (density data) obtained by density detecting sensor 80 detecting the density on the two-dimensional plane of patch image PI described above, control section 100 analyzes amplitudes A and B of the density unevenness on developing rollers 210A and 210B, and phase difference α between developing rollers 210A and 210B. That is, control section 100 frequency-analyzes the value of the density of patch image PI detected by density detecting sensor 80 with respect to the spatial frequency, thereby calculating amplitude values A and B of density unevenness caused by developing rollers 210A and 210B. Control section 100 calculates the difference between the density cycle of the density unevenness caused from first developing roller 210A and the density cycle of the density unevenness caused from second developing roller 210B, as phase difference α of second developing roller 210B from first developing roller 210A.

Figure 5:
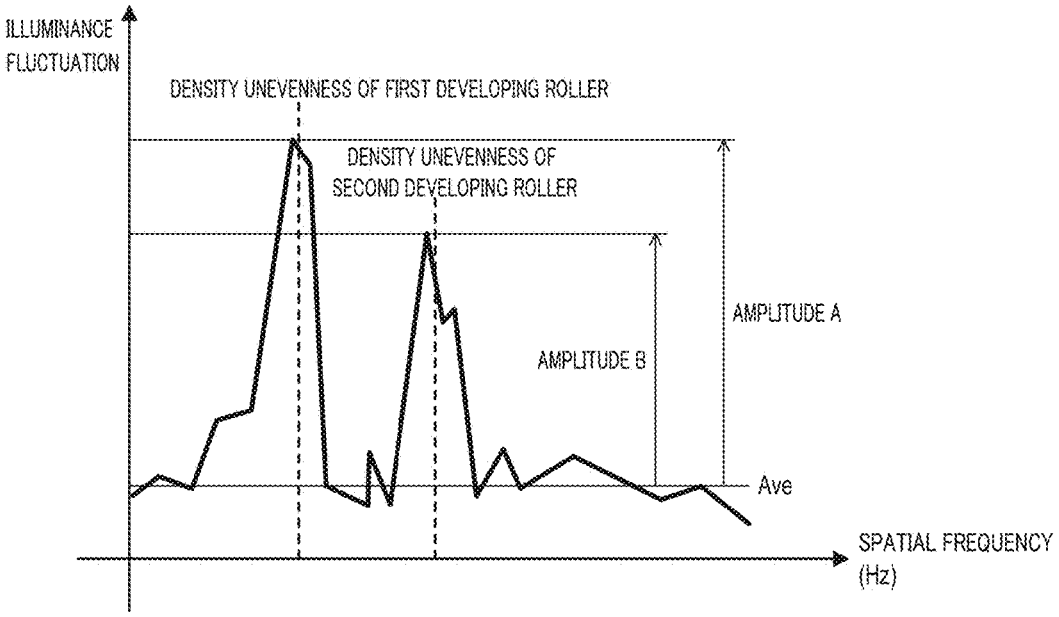
FIG. 5 is a characteristic graph illustrating the density unevenness of each of two developing rollers.

FIG. 5 illustrates a result of analysis by control section 100 as described above. In a characteristic graph of FIG. 5, the abscissa axis indicates the spatial frequency (Hz), and the ordinate axis indicates the value of fluctuating density (illuminance). In this case, as for amplitudes (A and B) of density unevenness with respect to the average value (Ave) of illuminance, first developing roller 210A has a larger value.

(3) Select a Correction Target (a Control Value to be Corrected) Pertaining to the Densities on Developing Rollers 210A and 210B FIG. 6 illustrates a combination of correction targets selectable during density correction according to this Embodiment. In FIG. 6, "development θ" is the ratio between the circumferential speed of developing roller (210A or 210B) and the circumferential speed of photoconductor drum 413. "AC" is the value of the AC component of the developing bias to be applied to developing roller 210A or 210B corresponding to developing bias power source (270A or 270B), and hereinafter also called "developing AC bias".

As illustrated in FIG. 6, in this Embodiment, any of development θ and developing AC for developing roller 210A or 210B may be corrected. Consequently, there are four combinations. The selection of the correction target may be preset manually by the user through a user selection screen or the like, not illustrated, or preset automatically by control section 100.

When the use situation of developing roller 210A (210B) is initial, i.e., the durability of the developing roller to be corrected is not exhausted, it is preferable to select development θ (i.e., rotation rate) of developing roller 210A (210B) as the correction target value. When the durability of developing roller 210A (210B) is exhausted to some extent, it is preferable to select the developing AC bias of developing roller 210A (210B) as the correction target value. At the durability initial time, correction of the value of development θ can more easily correct the density than correction of the AC bias value.

More specifically, when the AC bias value of developing roller 210A (210B) is corrected, carriers tend to adhere to photoconductor drum 413, or change in amount of toner adhesion to photoconductor drum 413 increases. Consequently, fine adjustment at the durability initial time is relatively difficult in comparison with the case of correcting the value of development θ. At the durability initial time, the surface of developing roller 210A (210B) does not so deteriorate. Consequently, correction of the development θ as the correction target value, i.e., the number of revolutions per unit time (the amount of conveyance of developer), can easily correct the density while utilizing the surface shape (concavity and convexity etc.) of developing roller 210A (210B). On the contrary, when the durability is exhausted to some extent, the surface shape (concavity and convexity etc.) of developing roller 210A (210B) further deteriorates. Accordingly, correction of development θ is not exerted well. Consequently, when the durability of developing roller 210A (210B) is exhausted to some extent, it is preferable to select the developing AC bias as the correction target value.

Consequently, it is set so that the case where correction target value is selected automatically by control section 100, control section 100 refers to the value indicating the durability exhaustion of developing roller 210A (210B) (e.g., the number of sheets printed after replacement of developing roller 210A (210B) and the like) when executing the density correction, and selects the correction target value.

(4) Calculate the Correction Amount for the Selected Correction Target

Figure 7:
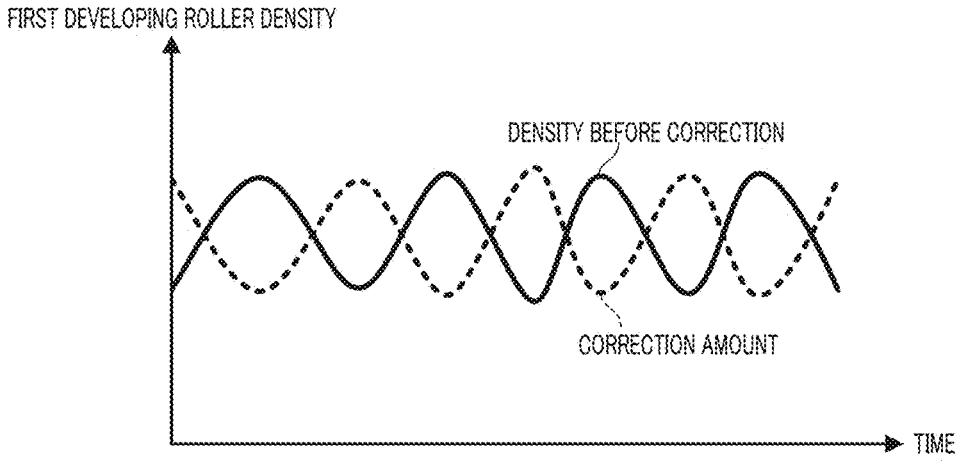
FIG. 7 is a characteristic graph illustrating an overview of the density unevenness and correction amount of a first developing roller on an upstream side.

Subsequently, control section 100 calculates the correction amount of the selected correction target value (i.e., development θ or developing AC bias). Here, FIG. 7 is a characteristic graph schematically illustrating the correction amount for the value of the density change by developing roller 210A before correction, and the selected correction target value. Likewise, FIG. 8 is a characteristic graph schematically illustrating the correction amount for the value of the density change by developing roller 210B before correction, and the selected correction target value.

Figure 8:
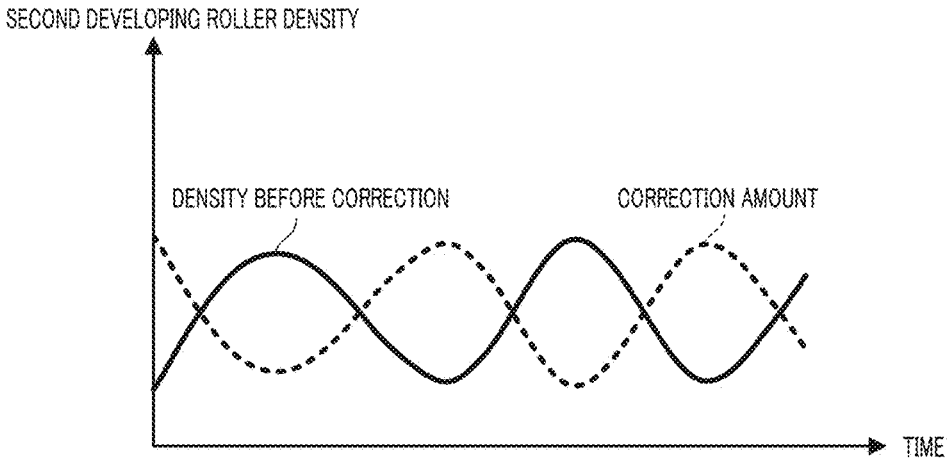
FIG. 8 is a characteristic graph illustrating an overview of the density unevenness and correction amount of a second developing roller on a downstream side.

In the graphs of FIGS. 7 and 8, the abscissa axis indicates the time, and the ordinate axis indicates the value of the density of toner supplied from one developing roller (210A or 210B) to photoconductor drum 413 when patch image PI is printed. In each graph, the density characteristics (density fluctuation curve) before correction are indicated by solid line, and the correction amount calculated by control section 100 is indicated by broken line.

As indicated by solid line in FIGS. 7 and 8, when patch image PI is printed, the density of toner supplied to photoconductor drum 413 increases and decreases with time. As a result, the density unevenness as illustrated in FIG. 4 occurs in patch image PI formed on photoconductor drum 413 and printed on sheet S. To make the density value of the toner supplied from each of developing rollers 210A and 210B to photoconductor drum 413 constant, that is, to cause the density characteristics to form a horizontally extending linear line and eliminate the density unevenness in patch image PI, a curve serving as the inverse function of the output density is added as the correction amount as indicated by the broken curve in FIGS. 7 and 8.

More specifically, it is assumed that "t" is time (time point), the amplitude of the density characteristics of first developing roller 210A is "A", and the rotation rate (angular frequency) of first developing roller 210A is "$\omega_A$", the function (density fluctuation curve) indicating the density characteristics of first developing roller 210A before correction is $A \sin(\omega_A \cdot t)$. Consequently, the function of correction amount for the density fluctuation curve (i.e., the curve of the inverse function of the output density) is $-A \sin(\omega_A \cdot t)$.

Likewise, it is assumed that the amplitude of the density fluctuation of developing roller 210B is "B", and the rotation rate (angular frequency) of developing roller 210B is "$\omega_B$", the density fluctuation curve of second developing roller 210B before correction is $B \sin(\omega_B \cdot t)$. Downstream second developing roller 210B has phase difference α from upstream first developing roller 210A. Consequently, the function (density fluctuation curve) indicating the density characteristics of second developing roller 210B before correction is $B \sin(\omega_B \cdot t - \alpha)$. Consequently, the function of correction amount for the density fluctuation curve (the inverse function of the output density) is $-B \sin(\omega_B \cdot t - \alpha)$.

Consequently, control section 100 calculates the correction amount of the selected correction target, using function $-A \sin(\omega_A \cdot t)$ for upstream developing roller 210A, and using function $-B \sin(\omega_B \cdot t - \alpha)$ for downstream developing roller 210B. At this time, as required, control section 100 may be notified of the value of angular frequency $\omega_A$ ($\omega_B$) and the like of developing roller 210A (210B), by another processor or the like.

(5) Calculate the Amount of Effect to Downstream Developing Roller 210B Due to Correction First, experiments performed by the present inventors and a knowledge obtained by the experiments are described. The present inventors applied correction amount "$-A \sin(\omega_A \cdot t)$" for developing roller 210A described above to development θ or developing AC bias, and applied correction amount "$\times B \sin(\omega_B \cdot t - \alpha)$" for developing roller 210B to development θ or developing AC bias, and repeated the experiment of printing patch image PI. That is, in the case of correcting development θ, drive motor 260A (or 260B) was controlled by control section 100 so as to apply the function of the correction amount described above and rotate developing roller 210A (or 210B), thereby printing patch image PI. On the other hand, in the case of correcting the developing AC bias, developing bias power source 270A (or 270B) was controlled by control section 100 so as to apply the function (correction function) of the correction amount described above and apply current to developing roller 210A (or 210B), thereby printing patch image PI. At this time, according to the four combinations of the correction targets described in FIG. 6, patch image PI was printed on sheet S repetitively, and the unevenness in image density of patch image PI on sheet S was measured through density detecting sensor 80.

However, in each patch image PI printed by the experiment, the density unevenness occurred, and a satisfactory result was not obtained. As a result of the present inventors' earnest research based on such an experiment, as described above, a knowledge was obtained that passing the developer from developing roller 210A to developing roller 210B caused errors in the values (correction values) of the developing AC bias and the development θ to be changed. Hereinafter, such a knowledge is described in further detail with reference to FIG. 9.

Figure 9:
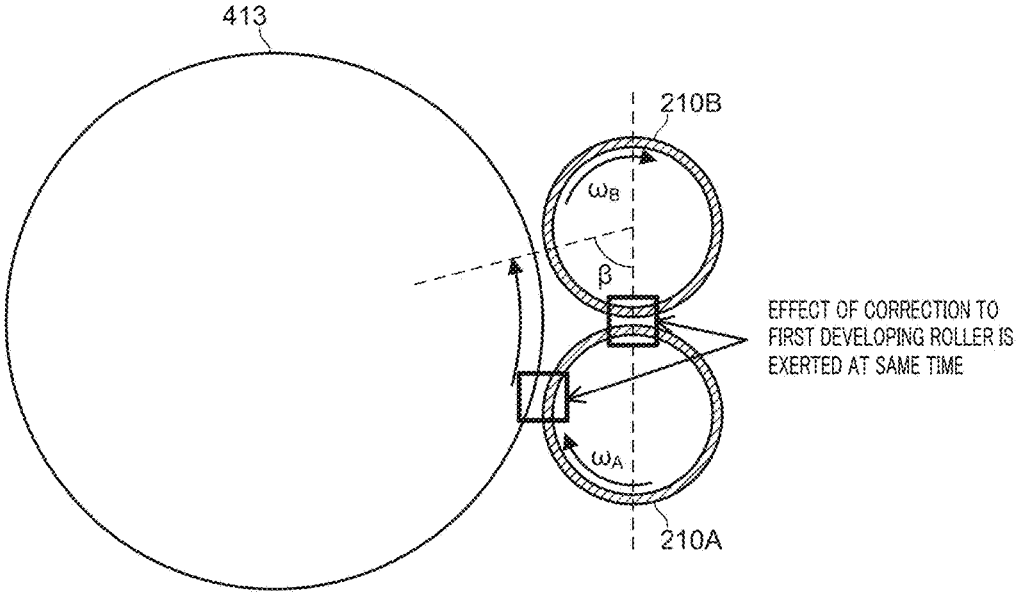
FIG. 9 illustrates an effect exerted, by the correction amount for one developing roller, on the other developing roller.

FIG. 9 assumes a case of correcting the developing AC biases of developing rollers 210A and 210B when correcting the density unevenness, and illustrates a situation where developing rollers 210A and 210B rotate with angular frequencies $\omega_A$ and $\omega_B$ described above. FIG. 9 indicates areas where the developer is passed from developing roller 210A, with solid-line rectangles.

As illustrated in FIG. 9, developing rollers 210A and 210B are disposed adjacent to each other. It was found that when the developer was passed from developing rollers 210A and 210B to photoconductor drum 413 and toner was supplied, the developer was passed from upstream developing roller 210A also to downstream developing roller 210B in the area encircled by the rectangle. It is found that when the value of the developing AC bias or development θ of upstream developing roller 210A was corrected (that is, changed), the amount or state of developer passed from developing roller 210A to photoconductor drum 413 was changed, and at the same time, the amount (state) of developer passed from developing roller 210A to developing roller 210B was also changed. It was also found that the opposite effect, that is, the effect exerted on upstream developing roller 210A when the value of the developing AC bias or development θ of downstream developing roller 210B was corrected (changed) was not required to be considered.

More specifically, the effect exerted on second developing roller 210B caused by correcting first developing roller 210A occurred at the same time point as the correction time point. The effect on second developing roller 210B fluctuated with a cycle according to the rotation rate of second developing roller 210B, from the start point of the correction time to first developing roller 210A. That is, until the developer passed in the developer passing area between developing rollers 210A and 210B was supplied from developing roller 210B to photoconductor drum 413, a delay occurred based on angle β between the passing area and the developing nip section (see the broken lines in the diagram) between developing roller 210B and photoconductor drum 413.

In an overview, the amount of effect (i.e., the changing amount of density fluctuation) to second developing roller 210B caused by the correction amount "$-A\sin(\omega_A \cdot t)$" to first developing roller 210A is represented in following Expression (1).

$$-A\sin(\omega_A \cdot t - \beta/\omega_B) \qquad \text{Expression (1)}$$

The right term in Expression (1), "$\beta/\omega_B$", corresponds to the delay time until the developer passed from first developing roller 210A to second developing roller 210B is supplied to photoconductor drum 413 during rotation of angle β, or the phase difference.

Consequently, control section 100 calculates the amount of effect caused on second developing roller 210B by correction to first developing roller 210A on the basis of Expression (1). At this time, as required, control section 100 may be notified of the values of angular frequency $\omega_A$ ($\omega_B$) and angle β of developing roller 210A (210B), by another processor or the like.

(6) Determine the Final Correction Amounts for Developing Rollers 210A and 210B Thus, control section 100 adds the amount of effect due to the correction to the correction amount to second developing roller 210B, thereby determining the final correction amount for each of developing rollers 210A and 210B. Here, the correction amount to each of developing rollers 210A and 210B before calculation of the amount of effect due to correction, that is, the primary correction value, is illustrated as a table in FIG. 10. The final correction amount to each of developing rollers 210A and 210B is illustrated as a table in FIG. 11.

As can be understood from the tables in FIGS. 10 and 11, the final correction amount to first developing roller 210A is the same as the correction amount in primary correction. This is because no developer is passed from downstream second developing roller 210B to upstream first developing roller 210A, and accordingly, the effect of the primary correction amount to downstream second developing roller 210B does not affect first developing roller 210A (the amount of effect is zero).

Meanwhile, the final correction amount to second developing roller 210B is a value obtained by applying (subtraction) "$-A\sin(\omega_A \cdot t - \beta/\omega_B)$" to the correction amount in primary correction "$-B\sin(\omega_B \cdot t - \alpha)$".

Accordingly, the final correction amount to each of developing rollers 210A and 210B is calculated by control section 100. Such a correction amount is applied to the selected correction target (development θ or developing AC bias), thereby accurately eliminating the density unevenness in each of developing rollers 210A and 210B. Consequently, the density unevenness in patch image PI described above is eliminated. Furthermore, the density unevenness and the image defects in a printed image in normal printing can be effectively suppressed.

Figure 12:
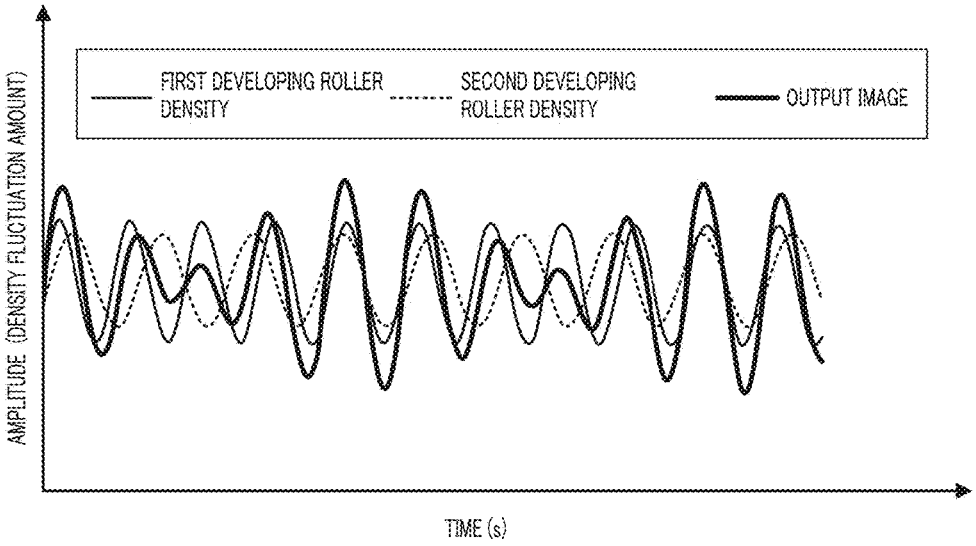
FIG. 12 is a characteristic graph illustrating a result of analyzing the density unevenness of the patch image according to this Embodiment.
Figure 13:
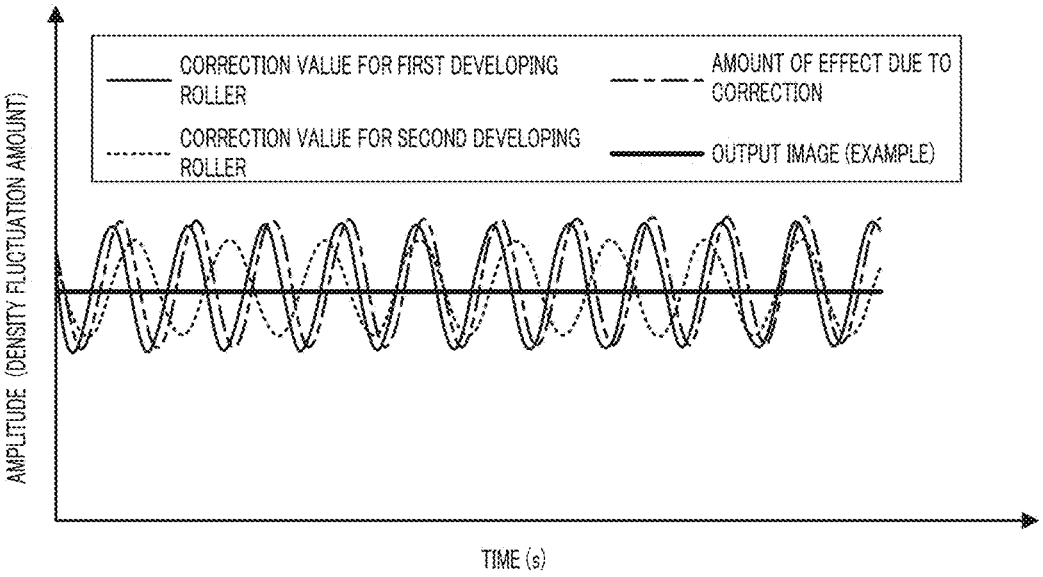
FIG. 13 is a characteristic graph illustrating a result and the like of density correction according to this Embodiment.
Figure 14:
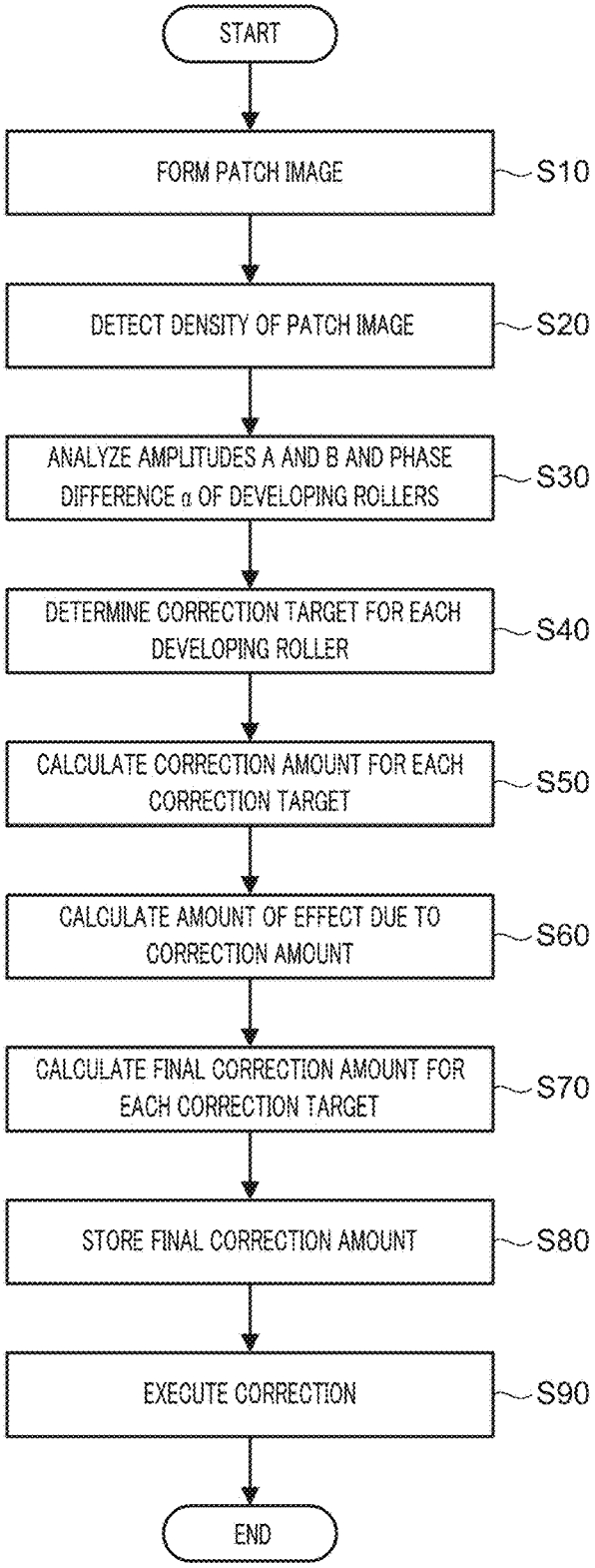
FIG. 14 is a flowchart illustrating a density correction process performed by a control section according to this Embodiment.

Next, referring to FIGS. 12 to 14, processes pertaining to density correction performed by control section 100 is described. Here, FIG. 12 is a characteristic diagram illustrating a result of analysis of patch image PI by control section 100 in aforementioned procedure (2). FIG. 13 is a characteristic diagram illustrating the result of application of the final correction amount in procedure (6) described above. FIG. 14 is a flowchart illustrating the processes of procedures (1) to (6).

Referring to FIG. 14, in step S10, control section 100 controls sheet conveying section 50, image formation section 40 including developing device 412, and fixing section 60 so as to form patch image PI on sheet S described with reference to FIG. 4 and the like. According to such control, image formation section 40 forms patch image PI on the upper surface of sheet S. Such sheet S passes through fixing section 60, thereby thermally fixing patch image PI and reading the density of patch image PI through density detecting sensor 80.

In step S20, control section 100 detects the distribution of density (density data) of patch image PI from the output signal of density detecting sensor 80. In subsequent step S30, control section 100 analyzes amplitudes A and B at developing rollers 210A and 210B and phase difference α from the detected density data on the patch image.

Here, referring to FIG. 12, control section 100 detects the density fluctuation amount of patch image PI from the output signal of density detecting sensor 80 at real time. The detection result is indicated by a thick line in FIG. 12. In the curve indicated by the thick line in FIG. 12, the density characteristics functions (i.e., "A $\sin(\omega_A \cdot t)$" and "B $\sin(\omega_B \cdot t-\alpha)$") at developing rollers 210A and 210B are combined.

Control section 100 frequency-analyzes such a curve (composite function), and separates the curve into the curve of density characteristics "A $\sin(\omega_A \cdot t)$" of first developing roller 210A indicated by a narrow line in FIG. 12, and the curve of density characteristics "B $\sin(\omega_B \cdot t-\alpha)$" of second developing roller 210B indicated by a broken line in the same diagram.

In step S40, control section 100 determines the control value to be corrected in each of developing rollers 210A and 210B among the four types described above with reference to FIG. 6.

In step S50, control section 100 calculates each determined correction amount (the correction function serving as primary correction) to be corrected, on the basis of the analysis result in step S30. In FIG. 13, the correction value (correction curve) for first developing roller 210A is indicated by a solid line, and the correction value (correction curve) for second developing roller 210B is indicated by a broken line. As can be understood from comparison with each of the density fluctuation curves in FIG. 12, these correction curves are the inverse functions of the density fluctuation curves.

In step S60, control section 100 calculates the amount of effect for second developing roller 210B due to the calculated correction amount. In FIG. 13, the function (curve) of the amount of effect for second developing roller 210B is indicated by a chain line. The process in step S60 can be omitted in a case where the correction amount for developing roller 210A is zero. This case is described later.

In step S70, control section 100 calculates the final correction amount for each of developing rollers 210A and 210B on the basis of the calculated amount of effect for second developing roller 210B.

In step S80, control section 100 stores the calculated final correction amount (correction function) in LUT of storing section 72 to update LUT.

In step S90, control section 100 controls image formation section 40 using updated LUT, thereby executing density correction for an image to be printed.

Such control of density correction can maintain the characteristics of the output image to achieve the shape of a flat line as indicated by the solid line in FIG. 13, eliminate the density unevenness in the toner image to be output onto photoconductor drum 413 and, in turn, sheet S, and effectively suppress image defects in the print image.

Other processing examples in steps S40 to S70 are described with reference to FIGS. 15 to 17.

In the above example, in step S50, control section 100 performs a process of applying the correction value to development θ or developing AC bias so as to eliminate the density fluctuation on each of developing rollers 210A and 210B and make the image density unevenness zero.

Meanwhile, as illustrated in a field "Image density unevenness of each developing roller due to correction" in FIGS. 15, 16 and 17, the process of applying the correction value may be performed so that the density fluctuations (image density unevenness) on developing rollers 210A and 210B are not zero and are inverse functions with respect to each other. In this case, on developing rollers 210A and 210B, each image density unevenness is left remained and such unevenness can be mutually eliminated, thereby eliminating image density unevenness to be formed on photoconductor drum 413 (see the bottom field in FIGS. 15 to 17).

The example illustrated in FIG. 15 is a case of calculating the final correction amount so that primary correction is applied only to first developing roller 210A without primary correction to second developing roller 210B, and such an amount of effect due to primary correction is reflected in secondary correction for second developing roller 210B.

The example illustrated in FIG. 16 is a case of calculating the primary correction amount of each developing rollers 210A and 210B so that half an amount to be originally corrected by first developing roller 210A is shared by (assigned to) second developing roller 210B.

According to still another example, as illustrated in FIG. 17, in an inverse manner from the case in FIG. 15, correction may be performed only for second developing roller 210B without correction for first developing roller 210A. In this case, control section 100 can assume the amount of effect to second developing roller 210B due to primary correction to be zero and omit the calculation process in step S60. That is, control section 100 applies amplitude (A $\sin(\omega_A \cdot t)$+B $\sin(\omega_B \cdot t)$) of density fluctuation and phase difference (−α) obtained in step S30, as the correction amount for second developing roller 210B (steps S50 and S70).

Embodiment described above uses the method of generating patch image PI to analyze (calculate) amplitudes A and B of density unevenness and phase difference α caused in developing rollers 210A and 210B, and detecting the density of such patch image PI using density detecting sensor 80.

According to another example, a displacement sensor including an optical section, such as a laser displacement sensor, may be adopted to measure directly the amount of gap (the physical fluctuation amount of the gap) at the developing nip section between photoconductor drum 413 and each of developing rollers 210A and 210B. In this case, control section 100 causes the displacement sensor to measure the fluctuation amount of the gap at each developing nip section while rotating photoconductor drum 413 and developing rollers 210A and 210B. Control section 100 then analyzes (calculates) the density fluctuation amount (amplitude and the like) caused at each of developing rollers 210A and 210B, on the basis of the fluctuation amount at the gap of each developing nip section obtained from the detection result (output signal) of the displacement sensor.

According to still another example, currents to be applied to each of drive motors 260A and 260B that drives developing roller 210A (210B) and caused torques may be monitored by control section 100, and the density fluctuation amount occurring at each of developing rollers 210A and 210B may be calculated from such a monitoring result. In this case, control section 100 calculates the fluctuation amount of the gap at the developing nip section between photoconductor drum 413 and each of developing rollers 210A and 210B, from the monitoring result, and analyzes (calculates) the density fluctuation amount (amplitude and the like) caused at each of developing rollers 210A and 210B, from such a calculated value.

Embodiment described above adopts the configuration where control section 100 has roles as the analysis section and the density correcting section. In another example, the functions of a part of or all the analysis section and the density correcting section may be performed by a dedicated processor. Here, the dedicated processor may encompass not only the internal processor in image forming apparatus 1 but also the external processor of an external apparatus communicable with image forming apparatus 1.

Although embodiments of the present invention have been described and illustrated in detail, the disclosed embodiments are made for purpose of illustration and example only and not limitation. The scope of the present invention should be interpreted by terms of the appended claims.

What is claimed is:

1. A developing device, comprising:

an image bearer that forms an electrostatic latent image;

a plurality of developing rollers each of which supplies toner to the image bearer, and develops the electrostatic latent image on the image bearer into a toner image; and a hardware processor that analyzes values representing density fluctuations during the toner being supplied from the developing rollers to the image bearer, for the respective developing rollers, and corrects a control value for an image density of at least one developing roller among the developing rollers based on a result of the analyzing so as to eliminate the density fluctuations, wherein the hardware processor corrects the control value for the image density of the at least one developing roller in consideration of an effect caused at the developing roller on a downstream side in a rotational direction of the image bearer by correcting the control value for the image density of the developing roller on an upstream side.

2. The developing device according to claim 1, wherein the hardware processor obtains amplitudes of the density fluctuations at the respective developing rollers, and a phase difference between the developing rollers, from the values representing the density fluctuations, and corrects the control value for the image density so as to eliminate the density fluctuation of the toner image on the image bearer.

3. The developing device according to claim 2, wherein the hardware processor applies a correction function to the control value for the image density so as to eliminate the density fluctuation in each of the developing rollers, the correction function using the amplitude of the density fluctuation and the phase difference.

4. The developing device according to claim 2, wherein the hardware processor obtains the amplitude of the density fluctuation and the phase difference at each of the developing rollers, from a detection result of a density detector detecting the density of the toner image formed on the image bearer.

5. The developing device according to claim 2, wherein the hardware processor obtains the amplitude of the density fluctuation at each of the developing rollers, from a detection result of a displacement sensor detecting a gap between each of the developing rollers and the image bearer.

6. An image forming apparatus, comprising:

the developing device according to claim 1;

a transferrer that transfers the toner image formed on the image bearer, onto a sheet; and a fixer that fixes the toner image transferred on the sheet.

7. The developing device according to claim 1, wherein when the hardware processor corrects the control value for the image density for the developing roller on the downstream side, the hardware processor corrects the control value for the image density so that, when supposing that the control value for the image density on the developing roller on the upstream side is corrected, a changing amount of the density fluctuation which occurs on the developing roller on the downstream side is added to a correction amount for the developing roller on the downstream side.

8. The developing device according to claim 1, wherein when the hardware processor corrects the control value for the image density for the developing roller on the upstream side, the hardware processor corrects the control value for the image density so that, when supposing that the control value for the image density on the developing roller on the upstream side is corrected, a changing amount of the density fluctuation which occurs on the developing roller on the downstream side is added to a correction amount for the developing roller on the upstream side.

9. The developing device according to claim 1, wherein when the hardware processor corrects the control values for the image densities for the developing rollers on the upstream and downstream sides, the hardware processor corrects the control value for the image density so that, when supposing that the control value for the image density on the developing roller on the upstream side is corrected, a changing amount of the density fluctuation which occurs on the developing roller on the downstream side is added to correction amounts for the developing rollers on the upstream and downstream sides.

10. The developing device according to claim 1, wherein the control value for the image density is a speed ratio of the developing roller to the image bearer, or an AC bias value of a developing bias current to be applied to the developing roller.

11. The developing device according to claim 10, wherein when a durability of the developing roller to be corrected is not exhausted, the hardware processor corrects the speed ratio of the developing roller, and when the durability of the developing roller to be corrected is exhausted, the hardware processor corrects the AC bias value of the developing bias current to be applied to the developing roller.

12. The developing device according to claim 2, wherein the hardware processor obtains the amplitude of the density fluctuation at each of the developing rollers, by frequency-analyzing the density of the toner image formed on the image bearer.

* * * * *